United States Patent [19]

Randall

[11] Patent Number: 4,780,709

[45] Date of Patent: Oct. 25, 1988

[54] DISPLAY PROCESSOR

[75] Inventor: Martin Randall, Santa Cruz, Calif.

[73] Assignee: Intel Corporation, Santa Clara, Calif.

[21] Appl. No.: 828,626

[22] Filed: Feb. 10, 1986

[51] Int. Cl.[4] ..... G09G 1/16

[52] U.S. Cl. ..... 340/721; 340/724; 340/789

[58] Field of Search ..... 340/721, 723, 724, 747, 340/798, 799, 789

[56] References Cited

U.S. PATENT DOCUMENTS

| | | | |
|---|---|---|---|
| 4,533,910 | 8/1985 | Sukonick et al. | 340/798 |
| 4,550,315 | 10/1985 | Bass et al. | 340/799 |
| 4,617,564 | 10/1986 | Yoshioka | 340/798 |
| 4,649,377 | 3/1987 | Urabe | 340/721 |
| 4,660,029 | 4/1987 | Houda et al. | 340/799 |

FOREIGN PATENT DOCUMENTS

| | | |
|---|---|---|
| 2144952 | 3/1985 | United Kingdom . |
| 2147772 | 5/1985 | United Kingdom . |

*Primary Examiner*—Gerald L. Brigance

*Attorney, Agent, or Firm*—Blakely, Sokoloff, Taylor & Zafman

[57] ABSTRACT

A display processor for displaying data in one or more windows on a display screen. The display processor divides a display screen into a plurality of horizontal strips with each strip further subdivided into a plurality of tiles. Each tile represents a portion of a window to be displayed on the screen. Each tile is defined by tile descriptors which include memory address locations of data to be display in that tile. The descriptors need only be changed when the arrangement of the windows on the screen is changed or when the mapping of any of the windows into the bit-map is changed. The display processor of the present invention does not require a bit map frame buffer to be utilized before displaying windowed data on a screen. Each horizontal strip may be as thin as 1 pixel, which allows for the formation of windows of irregular shapes, such as circles.

13 Claims, 3 Drawing Sheets

DISPLAY PROCESSOR

BACKGROUND OF THE INVENTION

1. Field of the Invention

This invention relates to the field of display processors for computer displays.

2. Background Art

As part of computer based information systems, it is often desired to provide a means for controlling the display of data on a output device such as a printer or screen, (for example, a Cathode Ray Tube (CRT)). In order to make a computer system operate more efficiently, a plurality of displays are superimposed on the screen at one time. Each of these individual displays is referred to as a "window" and typically each window represents different programs which are being executed by the computer. These windows often overlap onto the display screen, with only the topmost window being entirely visible. Although certain portions of the underlying windows are not visible, the data found in these portions is preserved in memory.

In the past, displays utilizing windows have used a number of window buffers, with each buffer containing data for a single window. Prior to display, the contents of the window buffers are mapped into a bit map frame buffer. The contents of this frame buffer are then read, typically in raster fashion, to provide the visual display. The order in which the window buffers are mapped into the bit map frame buffer depends on the order of the windows on the ultimate display.

The above-described method of generating window displays has the disadvantage of requiring a bit-block transfer of data in the frame buffer of the altered area each time a window is updated or a window position on the display screen is changed. This is a time consuming process and requires additional memory space to implement. Further, the data in those portions of windows underlying other windows must be stored in window frame buffers, adding to the time and memory requirements of such a window map system.

Therefore it is an object of the present invention to provide a display management system which allows the display of a plurality of overlapping windows with a minimum of storage updates and memory requirements.

It is another object of the present invention to provide a display management system which does not require a bit map frame buffer.

It is yet another object of the present invention to provide a display management system which allows for efficient display of plurality of windows on a computer display screen.

SUMMARY OF THE PRESENT INVENTION

The display management system of the present invention utilizes a display processor which employs a plurality of pointers and descripters to allow data to be read from window buffers directly onto a visual display without first compiling a bit map frame buffer. In the preferred embodiment, the screen is divided into a plurality of horizontal strips which may be a single pixel in width. Each horizontal strip is divided into one or more rectangular tiles. These tiles and horizontal strips are combined to form viewing widows. Since the tiles may be a single pixel in width, the viewing window may be arbitrarily shaped, such as, for example, circular or other irregular shape. The individual strips are defined by descriptors in a memory. The descriptors are updated only when the viewing windows on the display are changed. During generation of the display, the display processor reads the descriptors and fetches and displays the data in each tile without the need to store it intermediately in bit map form.

DETAILED DESCRIPTION OF THE PRESENT INVENTION

A display processor which allows the display of multiple windows on a display screen without the need for an intermediate bit map frame buffer is described. In the following description, numerous specific details are set forth, such as operating frequency, number of bits per descriptor, etc. in order to provide a more thorough understanding of the present invention. It will be obvious, however, to one skilled in the art, that the present invention may be practiced without these specific details. In other instances, well known circuitry has not been described in detail in order not to unnecessarily obscure the present invention.

Figure 1:
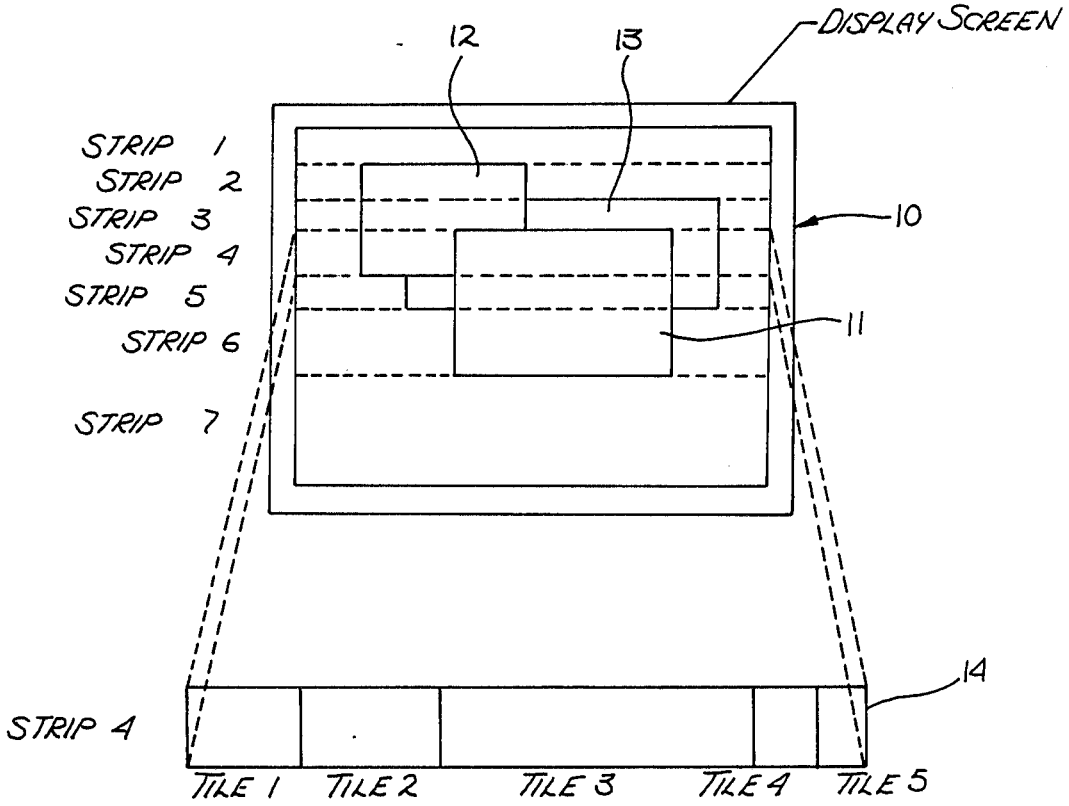
FIG. 1 is a diagram illustrating a computer display screen which has overlapping windows displayed thereon.

FIG. 1 is a diagram illustrating a display screen 10 showing overlapping windows 11, 12 and 13. Window 11 is the "topmost" window and is displayed in its entirety. A portion of window 12 is obscured by overlapping window 11 and portions of window 13 are obscured by both window 12 and window 11. As previously described, in the past, such a display would be generated by storing the information contained in each window in a plurality of window buffers. The contents of these window buffers would then be mapped into a frame bit map representing data for the entire display screen. This frame bit map would next be read in raster fashion onto the display screen resulting in the image shown in FIG. 1. However, such a process adds to the time and memory requirements of a display system.

The preferred embodiment of the present invention divides the screen into a plurality of horizontal strips such as strip 1 through strip 7 illustrated in FIG. 1. Each strip is then further subdivided into a plurality of tiles such as tile 1 through tile 5 shown in expanded view 14 of strip 4. The combination of strips and tiles results in the formation of a display with one or more windows displayed. In alternate embodiments, non-rectangular areas may be defined on the display and combined to form windows.

Referring again to FIG. 1, strip 1 contains only a single tile, that being background information of the display, with no window extending into strip 1. In the absence of windows, a field background color is displayed. The color may be chosen by the user. By using a background field for nonwindow areas the use of system bandwidth is maximized since data is only fetched for windows and not for background. This feature yields significant display processor bandwidth reductions, allowing an increase in system bandwidth for other devices coupled to the bus. This is a great advantage over prior art display systems. As previously mentioned, all windows in prior art systems are mapped into a bit map frame buffer. Each time a window is updated or window position is changed, a bit block transfer of information in the bit map frame buffer, for the altered area, including background or field information, is required. Additionally, all data is transferred at the same bit per pixel ratio as is on the screen, not selectively as in the present invention.

Strip 4 is divided into five tiles. Tile 1 represents background display information. Tile 2 is that portion of window 12 which has extended into strip 4. Tile 3 is that portion of window 11 present in strip 4, while tile 5 contains that portion of window 13 in strip 4. Tile 5 is background display information.

Information about each strip is set up as a series of descriptors. These descriptors provide information about the strips. For example, the number of lines in the strip, the number of tiles within the strips, the bits per pixel, the memory location to obtain tile information, etc. The display processor, when generating a display, sets pointers to the window buffer memory locations indicated in the descriptors. The data in these memory locations is then read directly to the display at the proper tile locations. In effect, the present invention does windowing on the fly. This has the advantages of eliminating steps required by prior art systems, increasing the speed of display generation, and decreasing the memory requirements of the display processor. The descriptors need only be updated when the viewport arrangement on the screen changes. If information within the windows changes, the descriptors still remain the same. The descriptors will retrieve data from the same memory locations, but that data will reflect changes occurring within a window. Only when the window arrangement on the screen is changed or when the mapping of the windows into the memory is changed, need the descriptors be updated. Thus, once the window arrangement is determined, the generation of the display is greatly simplified over prior art methods.

Figure 2:
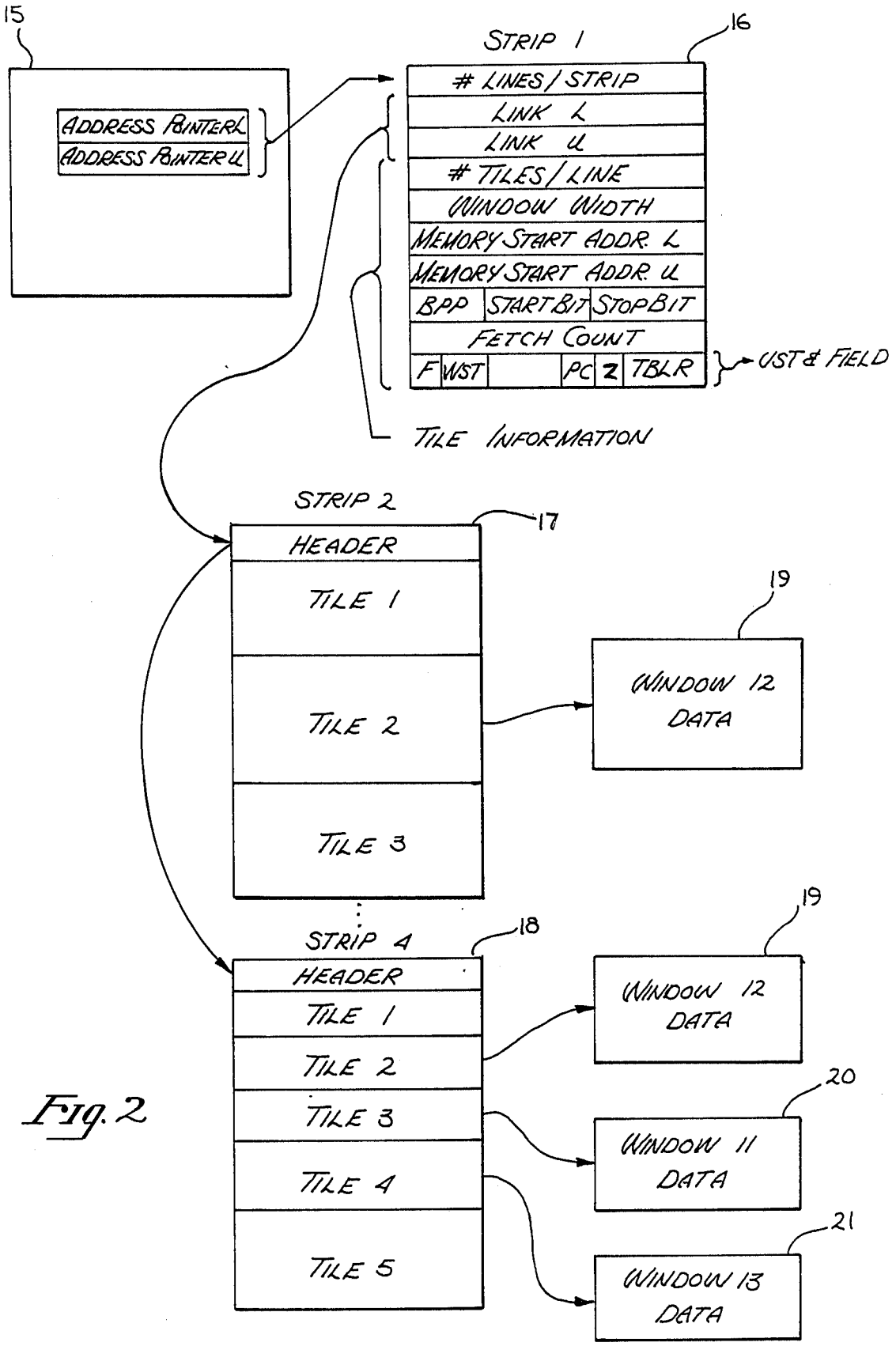
FIG. 2 is a block diagram illustrating the use of descriptors to define tiles and horizontal strips on a display screen.

The operation of the descriptors is illustrated in FIG. 2. The display processor utilizes address pointers 15 to point to the address of the first descriptor for the display. Address pointer L is the first descriptor for the display. Address pointer U is the most significant end of the descriptor address pointer. In the preferred embodiment of the present invention, descriptors are fetched by the display processor until the bottom of the screen is reached.

Each strip descriptor consists of a header followed by one or more tile descriptors all in one contiguous block in memory. The header consists of information which is generic to the entire strip such as number of lines per strip and the number of tiles in the strip. In the preferred embodiment of the present invention, there may be any number of lines in the strip with up to sixteen tiles within a single strip. A strip may be a single pixel in width or may be as wide as the entire screen. By utilizing strips one pixel in length, windows having nonrectangular shapes may be generated. This feature is described in more detail in conjunction with FIG. 4.

Within each strip descriptor is a plurality of tile information for that strip. Tile information includes the window width, memory start address, bits per pixel, start bit, stop bit, fetch count, F code, WST, PC, Z code and TBLR. The memory start address gives the start address of the window map location from which data is to be fetched. This address corresponds to the address of the first word of the bit map data in the tile (top left corner)

The number of bits per pixel (BPP) refers to the resolution of the window being accessed. In the preferred embodiment, this may be one, two, four or eight bits per pixel and is user determined.

The start number is the bit number in the first word to be displayed in the tile. Since the first word in a tile may be cut off within the word, the start number indicates the first bit of that word which actually appears in the tile. This gives bit resolution to the memory start address (and pixel resolution to the start of the tile).

The stop bit is the bit number in the word of the end of the displayed window. As was the case with the start bit, this bit indicates the last bit in the last word which actually appears in the window. It gives pixel resolution to the window width. Without the start bit and stop bit, only word resolution of the tile width could be obtained. By having pixel resolution of the tile width, as well as pixel resolution of the strip width, any window shape may be achieved in a display utilizing the present invention.

The fetch count indicates the number of words of bit map data to be fetched for the current window tile. When background information is to be displayed, the fetch count is ignored.

WST gives window status. In the preferred embodiment this is a two bit code that the user may output on window status pins while the window is being displayed. This code can be used to point to a pallette RAM to color that window, to multiplex in video data from another source, or any suitable user defined function.

The PC code indicates whether the window being displayed is from a bit map created in a special format. For example, in the preferred embodiment of the present invention, the PC code may indicate whether the bit map is created in an IBM PC format. By activating this code, the display can consist of a single window in which the display format of a certain type of computer is displayed or a window displaying that computer's format can be displayed along with windows in the format of the display processor. Although an example has been given of an IBM PC format, it will be obvious that other display formats may be incorporated into the present invention.

The Z code indicates whether the window is to be zoomed. The F code indicates whether the window is background field. When the field bit is set, the fetch count is ignored by the display processor and the number of pixels of field to be displayed is programmed into what would normally be the BPP, start bit and stop bit fields. TBLR is a border control code. In the preferred embodiment of the present invention, each window may have a border on the top, bottom, left, right, all sides or any combination of sides of the window.

As previously noted, the display processor reads indicators until the bottom of the screen is reached. The indicator for strip one of FIG. 1 consists of field information. For strip two the indicator consists of header information, and three tiles. Tile 1 and tile 3 are field tiles, while tile 2 contains information for window 12. The memory start address will direct the processor to the bit map 19 for window 12 data. The header information for strip 2 directs the processor to the descriptor for strip 3 and the header for strip 3 directs the processor to the descriptor for strip 4 which is described in detail in FIG. 2.

The descriptor 18 for strip 4 shows how the descriptor is arranged when overlapping windows appear on the screen. Tile 1 of strip 4 is field data, tile 2 accesses the bit map memory 19 for window 12, tile 3 containing information from window 11 accesses buffer memory 20 for window 11. Tile 4 contains a portion of information from window 13 and accesses the buffer memory 21 containing that data. Tile 5 is a background field tile.

Figure 4:
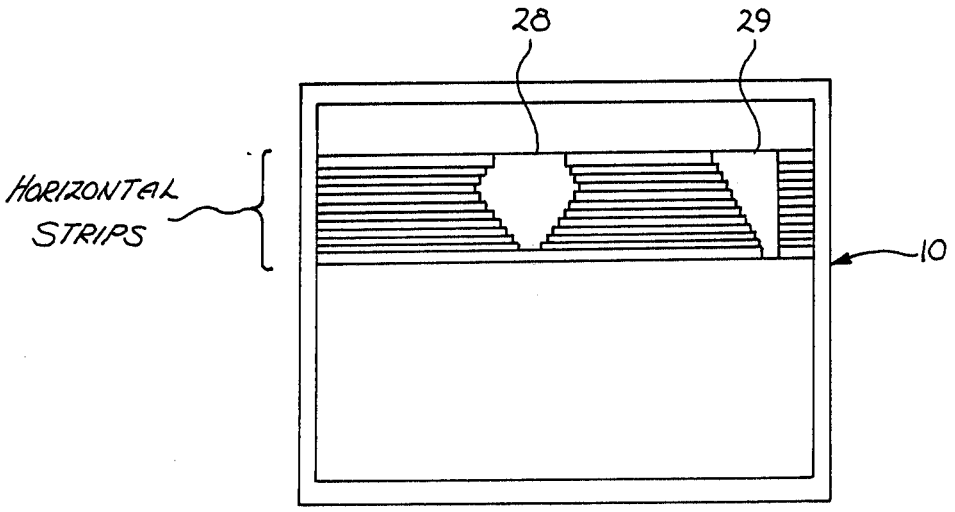
FIG. 4 is a diagram illustrating a computer display screen which has windows of irregular shape displayed thereon.

Although the windows 11, 12 and 13 of FIG. 1 are shown as rectangular, by varying the width of the horizontal strips, any shape of window may be achieved. For example, FIG. 4 illustrates how a curved window 28 or angled window 29 may be obtained. Within each horizontal strip, only rectangular tiles may be generated. But by making consecutive strips very thin, the appearance of a curved or angled window can be generated. Obviously, the smoothness of the curved or angled line depends on the width of the horizontal strips. The thinner the strips, the smoother the line. As noted previously, the horizontal strips in the preferred embodiment may be as thin as one pixel and the tiles themselves have pixel resolution in their width. Thus, a tile of a single pixel may be defined utilizing the present invention.

Figure 3:
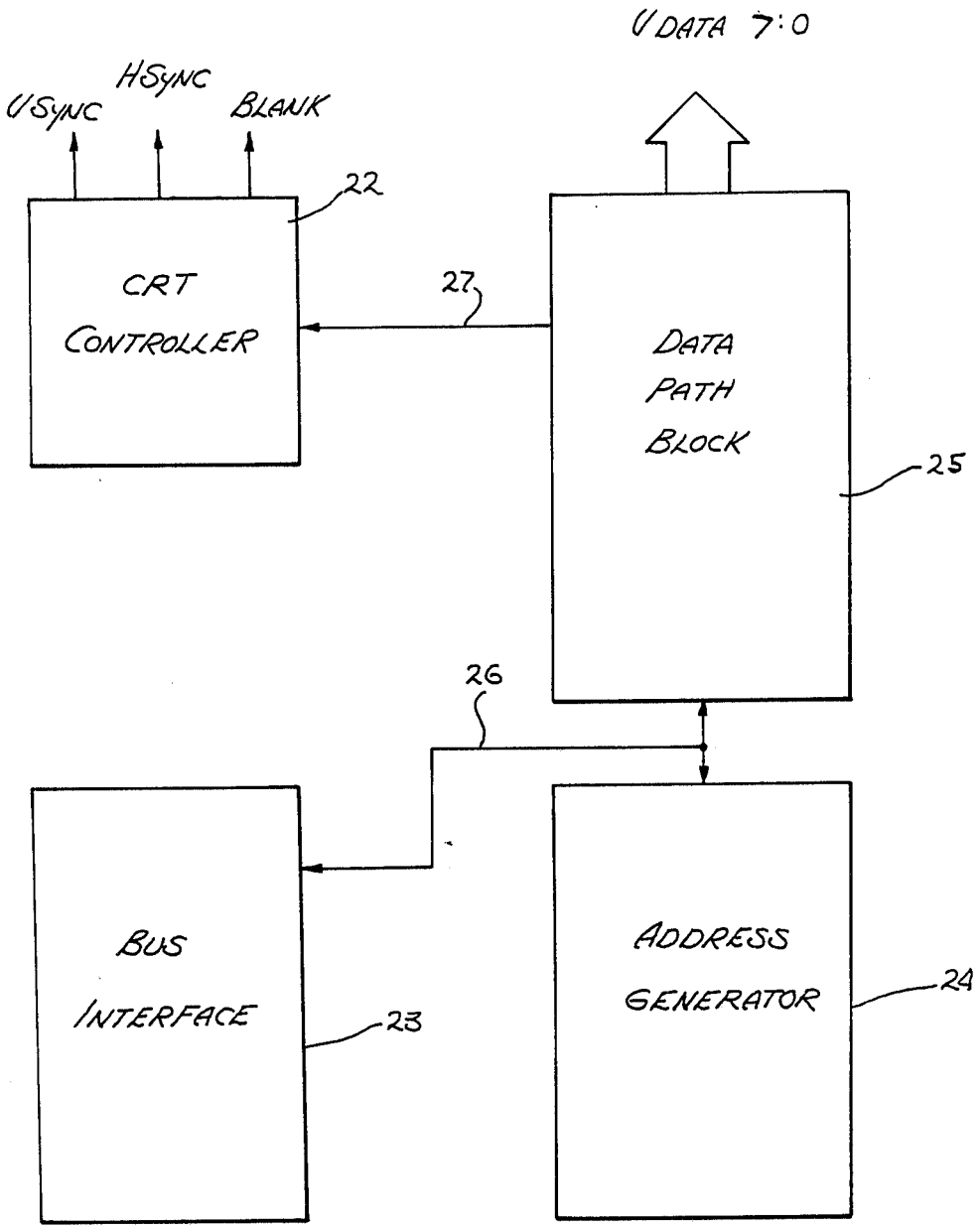
FIG. 3 is a block diagram illustrating the preferred embodiment of the display processor of the present invention.

The layout of the display processor of the present invention is illustrated in the block diagram of FIG. 3. A bus interface 23 provides a means of communicating with a bus leading to the window buffers. The bus interface 23 is coupled through line 26 to address generator 24 and data path block 25. The address generator 24 includes a RAM which stores the descriptors. Each tile descriptor contains six words (window width, memory start address L, memory start address U, bits per pixel, fetch count and field information) and up to 16 tiles may be defined in any one horizontal strip. In the preferred embodiment of the present invention, the descriptors for a single horizontal strip are stored in the address generator with the information updated during the horizontal blanking time of the display. The bus interface 23 fetches data from the window buffers according to the memory address information of the descriptors stored in the address generator 24. This data is supplied to the data path block 25 along with display control bits such as start bit, stop bit, bits per pixel, zoom, field and border, etc.

The data path block 25 contains control logic and is coupled to the video data output pins 0–7. This block also controls cursor and windowing functions. The data path block includes a FIFO which acts as a buffer between the system bus (through bus interface 23) and the video bus (through video output pins 0–7). Thus, data can be prefetched ahead of its display. The video data is outputted to the display on output pins 0–7.

The CRT controller 22 generates horizontal and vertical synchronization for the CRT screen and the blank control. In the preferred embodiment of the present invention, the display may be noninterlaced, interlaced (displaying the even lines first and the odd lines second of the frame) or an interlace synchronization (with the odd field display identical to the even field display). The CRT controller is utilized with the preferred embodiment of the present invention. When non raster scanned displays are utilized, vertical and horizontal synchronization may be required.

At the end of each frame, the bus interface is used to synchronize register updates. Instruction execution automatically takes place during vertical blanking, meaning that any changes to the format of the display are automatically synchronized with the display refresh. There is no requirement that the user determine when the update occurs as is the case in the prior art.

As noted above, each tile descriptor contains information on bits per pixel information. As a result, on the display screen there may be windows displaying data at 8 bits per pixel resolution at the same time as windows displaying data at 1, 2 or 4 bits per pixel resolution. Additionally, data is pulled from memory only at the bit per pixel rate at which it is to be displayed.

Although the preferred embodiment of the present invention provides an efficient manner of generating a raster scan display, the concept of utilizing pointers to generate specific areas of a display may be applied to other displays, such as printers and screens which are not raster scanned. In addition, although the preferred embodiment utilizes rectangular shaped tiles and stripes, other shapes may be advantageously employed using the teaching of the present invention.

When non raster scanned displays are utilized, it is contemplated that when a particular area of the display is to be changed, descriptors pointing to only the effected memory areas need be utilized. In such an embodiment, the descriptors need not define strips and tiles, but can be used to describe areas of a display.

Thus, a display processor which does not require a bit map frame buffer when displaying one or more windows is described.

I claim:

1. A device for controlling a display of pixel data on a video display, comprising:

interface means for communicating with a data source for said display;

address generator means coupled to said interface means for storing a plurality of strip descriptors, each of said strip descriptors defining a horizontal strip of said video display comprising a user deiinable number of scan lines of said display;

said strip descriptors for providing a plurality of windows onto a background field of said video display, wherein overlapping windows are achieved by having more forwardly disposed windows being displayed over less forwardly disposed windows, such that overlying portions of more forwardly disposed windows are exposed for display and underlying portions of less forwardly disposed windows are not displayed;

each said horizontal strip being divided into at least one segment, wherein boundaries of said segments are determined by a beginning and ending edges of each said strip, and exposed beginning and ending edge of said windows, such that each segment corresponds to either of continuous exposed portion of a same window or to said background field;

each strip descriptor identifying its segments and addressing pixel data corresponding to its segments; and each strip descriptor also providing corresponding pixel parameters to control display of said addressed pixel data;

logic means coupled to said address generator means for receiving said pixel data addressed by said strip descriptors and operating on said addressed pixel data according to said corresponding pixel parameters.

2. The device of claim 1 further including control means coupled to said logic means for providing horizontal and vertical synchronization for said display.

3. The device of claim 1 wherein each of said strip descriptors includes a header for designating number of scan lines and number of tiles for its strip; and a tile descriptor for each title in said horizontal strip, said tile descriptor providing said pixel parameters.

4. The device of claim 3 wherein said tile descriptors contain information defining the length of said tile, memory address locations of data to be displayed in said tile and define the number of bits per pixel which are to be displayed on said display.

5. A method for displaying pixel data is a plurality of windows on a display comprising the steps of:

dividing said display into a plurality of horizontal strips, each strip comprised of a user definable number of scan lines of said display;

dividing said horizontal strips into at least one segment (tile);

defining a strip descriptor for each one of said horizontal strips, said strip descriptors including a header to designate number of scan lines and tiles for its respective horizontal strip and a tile descriptor to define pixel parameters for said respective horizontal strip;

said strip descriptors for providing said plurality of windows onto a background field of said display, wherein overlapping windows are achieved by having more forwardly disposed windows being displayed over less forwardly disposed windows, such that overlying portions of more forwardly disposed windows are exposed for display and underlying portions of less forwardly disposed windows are not displayed;

each said horizontal strip having tile boundaries being determined by a beginning and ending edges of each said strip, and exposed beginning and ending edges of said windows, such that each tile corresponds to a continuous exposed portion of a same window or to said background field;

displaying pixel data referenced in each of said tiles dependent on said tile descriptor.

6. The method of claim 5 wherein each of said descriptors includes its length, memory address locations of pixel data to be displayed and a number of bits per pixel to be displayed.

7. The method of claim 6 wherein said display screen is a Cathode Ray Tybe (CRT).

8. The method of claim 7 wherein said strip descriptors are stored in a buffer memory.

9. The method of claim 8 wherein said buffer memory is updated during a horizontal blanking period of said CRT.

10. The method of claim 9 wherein a first window has a different number of bits per pixel than a second window.

11. The method of claim 6 wherein said display comprises a printer.

12. A device for controlling a display of pixel data on a video display, comprising:

interface means for communicating with a data source for said display;

address generator means coupled to said interface means for storing a plurality of strip descriptors, each of said atrip descriptors defining a horizontal strip of said video display comprising a user definable number of scan lines of said display;

said strip descriptors for providing a plurality of windows onto a background field of said video display, wherein overlapping windows are achieved by having more forwardly disposed windows being displayed over less forwardly disposed windows, such that overlying portions of more forwardly disposed windows are exposed for display and underlying portions of less forwardly disposed windows are not displayed;

each said horizontal strip being divided into at least one segment (tile), wherein boundaries of said segments are determined by a beginning and ending edges of each said strip, and exposed beginning and ending edges of said windows, such that each segment corresponds to either of continuous exposed portion of a same window or to said background field;

each strip descriptor identifying its segments and addressing pixel data corresponding to its segments; and each strip descriptor also providing corresponding pixel parameters to control display of said addressed pixel data.

logic means coupled to said address generator means for receiving said pixel data addressed by said strip descriptors and operating on said addressed pixel data according to said corresponding pixel parameters, said pixel parameters including memory starting address, bits per pixel, start and stop bits, wherein said start and stop bits are used when start and end of said segment is not at a beginning or end of an address word defining said window on said display.

13. The device of claim 12 wherein each of said strip descriptors includes a header for designating a number of scan lines and number of tiles for its strip; and a tile descriptor for each title in said horizontal strip, said tile descriptor providing said pixel parameters.

* * * * *